United States Patent [19]

Boik et al.

[11] 4,347,940

[45] Sep. 7, 1982

[54] LEVER-OFF TAMPER-INDICATING COMPOSITE CLOSURE

[75] Inventors: Elmer J. Boik, Lombard; F. Paul Marshall, Park Forest, both of Ill.

[73] Assignee: The Continental Group, Inc., Stamford, Conn.

[21] Appl. No.: 252,714

[22] Filed: Apr. 10, 1981

[51] Int. Cl.[3] ..... B65D 41/32

[52] U.S. Cl. ..... 215/253; 215/262; 215/304

[58] Field of Search ..... 215/262, 304, 250, 253; 220/285, 270

[56] References Cited

U.S. PATENT DOCUMENTS

| | | | |
|---|---|---|---|
| 970,037 | 9/1910 | Gilfillan | 215/304 |
| 2,043,738 | 6/1936 | Darling | 220/285 |
| 2,100,558 | 11/1937 | Zivanow | 220/285 |
| 2,980,299 | 4/1961 | Smith . | |
| 3,028,992 | 4/1962 | Bucher et al. | 220/270 |
| 3,128,004 | 4/1964 | Soffer | 220/285 |
| 3,934,722 | 1/1976 | Goldberg | 215/253 X |

FOREIGN PATENT DOCUMENTS

| | | |
|---|---|---|
| 507443 | 12/1954 | Italy . |
| 544292 | 4/1942 | United Kingdom . |

*Primary Examiner*—Donald F. Norton
*Attorney, Agent, or Firm*—Charles E. Brown

[57] ABSTRACT

A closure particularly intended for sealing containers having products packed therein under high vacuum wherein the vacuum retains the closure in place and a very high lifting or prying force is required to unseat the closure from the container to effect the removal thereof. The closure is provided with a supporting band which is interlocked with the shall of the closure and which supporting band has integrally formed as a part thereof a lever which is engageable with a shoulder on an associated container to effect the necessary lifting or prying action. The lever and associated supporting band are preferably injection molded of plastic material and may either be mechanically interlocked with the closure shell or molded in situ relative thereto. There are also suitable tamper indicating means.

15 Claims, 11 Drawing Figures

LEVER-OFF TAMPER-INDICATING COMPOSITE CLOSURE

This invention relates in general to new and useful improvements in closures, and more particularly to closures which require considerable force in the removal thereof.

This invention is particularly directed, although not limited, to closures for containers wherein the product is vacuum packed and thus the vacuum applies a retaining force on the closure which must be overcome before the closure can be removed from the container.

With closures on the order of 58 mm. at a vacuum of 25 inches Hg, the force holding the closure on the container may be as high as 36 pounds, which requires a substantial mechanical advantage to lift the closure off of an associated glass bottle neck finish.

In accordance with this invention a conventional metal closure has associated therewith a plastic supporting band which, in turn, carries a lever. The lever is pivotally connected to the supporting band and is engageable with an adjacent underlying shoulder on the container neck finish so as to be operable to pry the closure upwardly relative to the neck finish so as to release the vacuum.

The band is molded separate and apart from the closure and may either be in the form of a band which has a snap interlock with the closure or one which is molded in situ on the closure.

The support is also provided with tamper-indicating means which must be ruptured before the lever can be actuated. The tamper-indicating means may be simply extensions on the support having rupturable links with the lever, or may be in the form of a strap which extends over the lever and must be released before the lever can be actuated.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
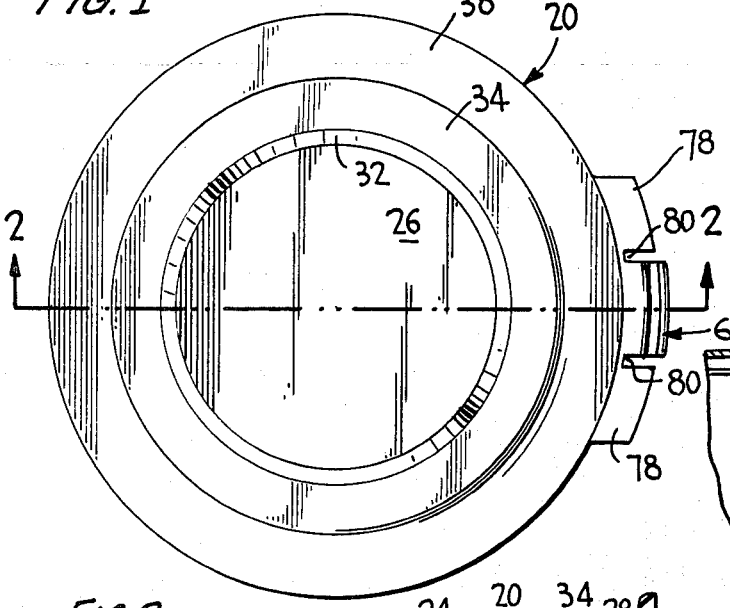
FIG. 1 is a top plan view of a conventional closure having attached thereto lever means in accordance with the invention.

Referring now to the drawings in detail, reference is first made to the embodiment of FIGS. 1–5 wherein there is illustrated a conventional closure 20 having associated therewith a lever mechanism 22. The closure 20 includes a metal shell 24 which includes an end wall 26 and a skirt 28.

The end wall 26 includes a recessed central panel 30 which is defined by an upwardly and radially outwardly sloping flange 32 which terminates in an annular outer end wall portion 34.

The skirt 28 includes an upper portion 36 which terminates at its lower edge in a horizontal annular shoulder 38 which, in turn, terminates in a lower skirt portion 40 which is of a greater diameter than the upper skirt portion 36. The lower skirt portion 40 terminates in a radially inwardly and upwardly turned curl 42.

It is to be noted that the flange 32, the end wall portion 34 and the skirt portion 36 all combine to define a channel 44 in which there is seated a ring of suitable sealing material 46. The sealing material 46 is seatable on a terminal neck finish surface 48 of the neck finish 50 of a glass container 52. The container 52, of course, could be formed of other materials including plastic and metal.

The closure 20 as described is suitable for closing a container 52 and has no interlock with the container to retain it in place. It is to be understood that the container 52 is to be packed with a suitable product under vacuum conditions and that the vacuum within the container 52, in combination with the atmospheric external pressure, tightly urges the closure on the container 52, and as long as the vacuum is maintained, the closure 20 will be held in place.

This invention particularly relates to the addition of the lever mechanism 22 to facilitate the removal of the closure 20 by way of prying action.

The lever mechanism 22 includes a generally L-shaped cross-sectional band 54 having a vertical leg 56 and a horizontal leg 58. At the intersection of the legs 56 and 58 in the internal corner, there is defined a socket 60. The band 54 is so proportioned that when it is snapped into place with respect to the skirt 28, the curl 42 snaps into the socket 60 and the upper end of the leg 56 engages the shoulder 38. It is also pointed out here at this time that the extreme upper portion of the leg 56 is tapered as at 62 so that it may deflect under pressure when the band 54 is installed.

It is also to be noted that the band 54 has formed on the inner face of the leg 56 adjacent the lower edge of the leg 56 suitable lugs 64 which are circumferentially spaced and project radially inwardly for the purpose of bearing against the exterior surface of the neck finish 50 and thus to aid in preventing deflection of the band 54.

The horizontal leg 58 has formed as an extension thereof a generally L-shaped lever 66 which includes an upstanding arm 68 and a base 70, the base 70 being a continuation of the leg 58. If desired, the extreme lower part of the arm 68 may be provided with a radially outwardly projecting bead 72.

Figure 4:
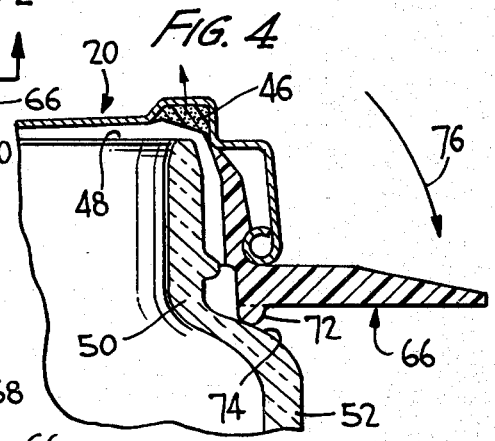
FIG. 4 is an enlarged fragmentary vertical sectional view showing the lever mechanism in use in lifting or prying the closure up relative to an associated container.
Figure 2:
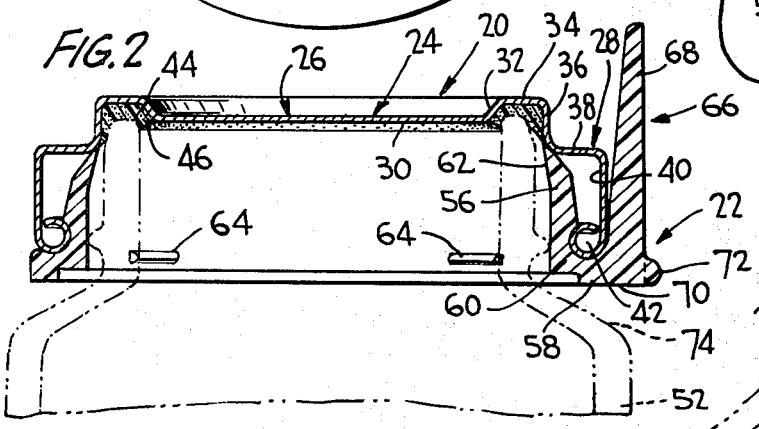
FIG. 2 is a vertical sectional view taken generally along the line 2—2 of FIG. 1, and shows the specific details of the closure and the lever mechanism, there also being shown in phantom lines the container with which the closure is normally associated.
Figure 5:
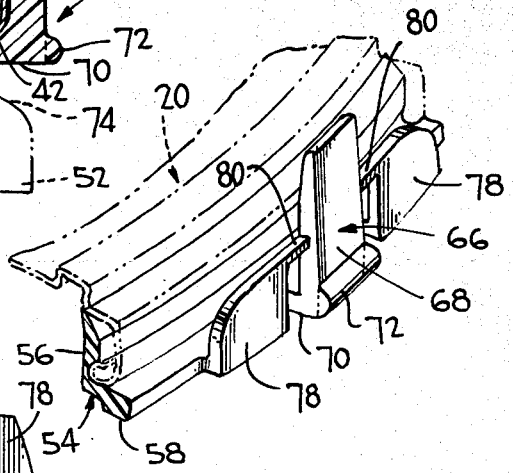
FIG. 5 is a fragmentary perspective view showing the details of the supporting band and lever as well as the tamper-indicating means in association with a portion of the closure, the closure being shown in phantom lines.
Figure 3:
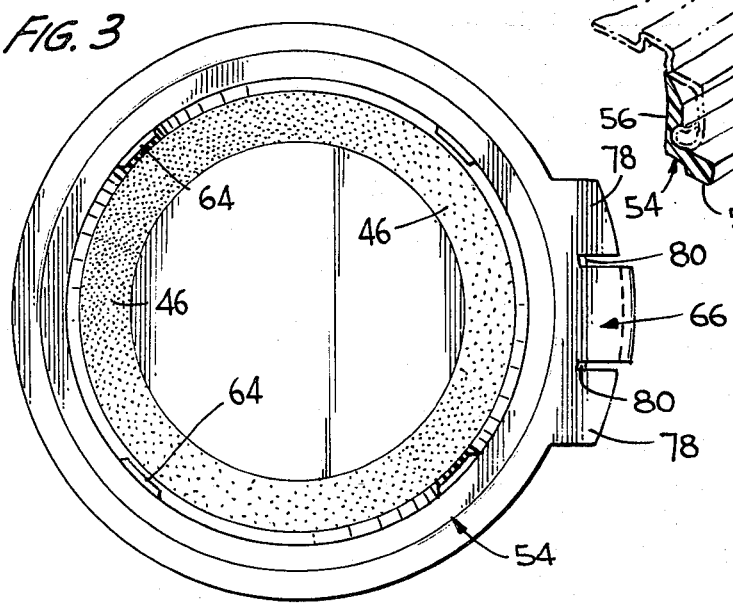
FIG. 3 is a bottom plan view of the closure of FIG. 1, and shows further the details thereof.
Figure 6:
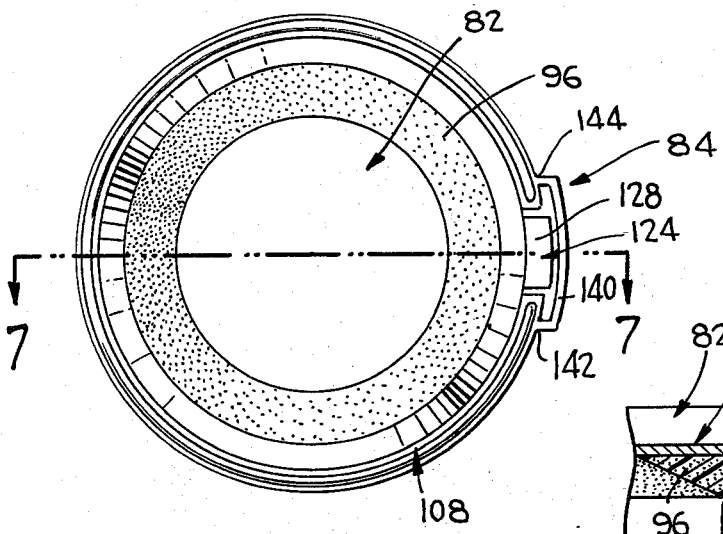
FIG. 6 is a bottom plan view of a closure similar to that of FIG. 1 having associated therewith a modified and preferred embodiment of the lever mechanism.

With particular reference to FIG. 4, it will be seen that the configuration of the container 52 is one wherein there is a shoulder 74 underlying the lever 66. When the lever 66 is pivoted downwardly in a clockwise direction as indicated by the arrow 76 in FIG. 4, the lever 66 will engage the shoulder 74 and pry the closure 20 upwardly so that the sealing ring 46 disengages from the neck finish sealing edge 48 and thus breaks the seal between the closure and the container and permits air to enter into the container, thus relieving the vacuum. Once the pressure within the container equalizes with that of the outside air, the closure 20 may be readily manually removed.

In accordance with the invention, it is preferred that the lever mechanism be provided with a tamper-indicating feature. To this end, the band 54 has integrally molded with the leg 58 on opposite sides of the lever 66 a pair of upstanding ears 78. The ears 78 lie generally in the plane of the arm 68 and are circumferentially spaced from the arm 68. Each ear 78 is provided with a very thin or small cross section bridge 80 which is integrally bonded with adjacent side edges of the arm 68. When the lever 66 is actuated, the bridges 80 rupture and indicate that the closure has been tampered with and there is a possibility that it has been opened at least to the extent of partially relieving the vacuum therein.

It is to be understood that the constructional details of the band 54 and the engagement of the upper portion 62 of the arm 56 against the shoulder 38 serve to stabilize the band 54 while the portion of the leg 58 thereof associated with the lever 66 may twist as shown in FIG. 4.

Reference is now made to FIGS. 6–11 wherein there is illustrated a slightly different form of closure 82 having associated therewith a modified form of lever mechanism 84 which at the present is the preferred embodiment of the invention.

The closure 82 includes an end wall 86 and a depending skirt 88. The skirt 88 includes an upper skirt portion 90 which terminates in a downwardly and radially outwardly sloping shoulder portion 92 which, in turn, terminates in a lower skirt portion 94. The skirt portions 90 and 94 are generally cylindrical with the skirt portion 94 being of a larger diameter than the skirt portion 90.

Preferably the closure 82 has the above-described shell thereof formed of metal and the end wall 86 is provided with an annular, formed in situ, band of sealant 96 which is disposed in the corner defined by a radially outer portion of the end wall 86 and the upper skirt portion 90.

The closure 82 as it is described is, in and of itself, functional and normally is associated with a neck finish 98 of a container 100. The neck finish may include an external bead 102, which is a centering bead, and a shoulder defining bead 104. Further, the container 100 is preferably formed of glass, although the closure 82 may function equally as well with containers formed of plastic and metal.

The neck finish 98 has a terminal sealing surface 106 which becomes embedded in the sealant 96 to form an airtight seal between the closure 82 and the container 100. The closure 82 is utilized with the container 100 when the product of the container 100 is vacuum packed, and thus the closure 82 is held in place by the differential pressure between the interior of the container and the external atmosphere.

The lever mechanism 84 includes a molded in situ band generally identified by the numeral 108, the band 108 being formed of a suitable injection molded plastic material. The band 108 includes a lower inner ring 110 which terminates at its lower edge in a horizontal ring 112. The band 108 extends upwardly from the radially outer edge of the ring 112 in a cylindrical ring 114 which is concentric with the ring 110. Next, the band 108 has an upwardly and radially inwardly sloping intermediate portion 116 which terminates at its upper edge in an upper outer cylindrical ring 118. The ring 118, in turn, terminates in a horizontal ring 120.

It will be seen that the band 108 corresponds to the external configuration of the shell of the closure 82 and further extends under the lowermost edge of the skirt portion 94 and up inside of the skirt portion 94, terminating in an abutment with the shoulder 92. Thus the band 108 is firmly interlocked with the shell of the closure 82.

Figure 8:
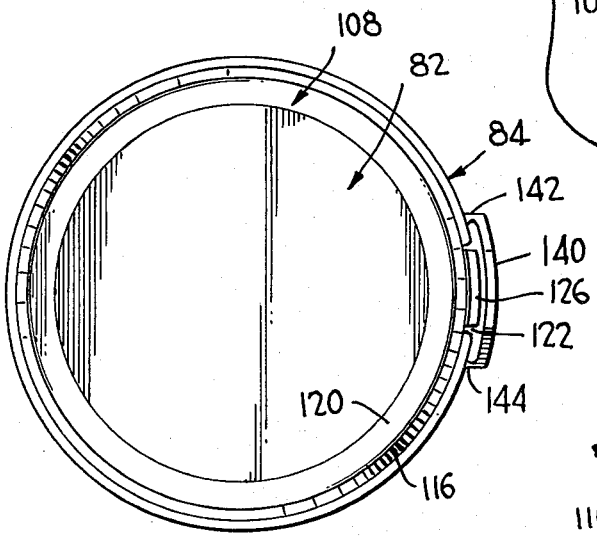
FIG. 8 is a top plan view of the closure of FIG. 6.
Figure 11:
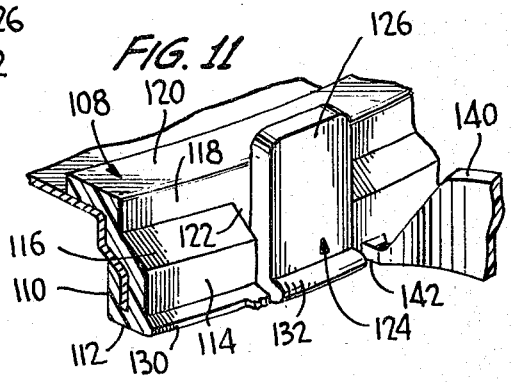
FIG. 11 is an enlarged fragmentary perspective view of the closure in the vicinity of the lever, and shows the tamper-indicating means in a released position.

The rings 114 and 116 are interrupted to leave an opening 122 as is best shown in FIGS. 8 and 11. In alignment with the opening 122 is an upstanding lever 124. The lever 124 includes a generally vertical arm 126 and a generally horizontal base 128 which forms a radial extension of the ring 112.

If desired, as is best shown in FIG. 11, the ring 112 may have formed therewith a radially outwardly projecting bead 130 which may include as an extension thereof a bead 132 on the lower end of the lever 124.

Figure 9:
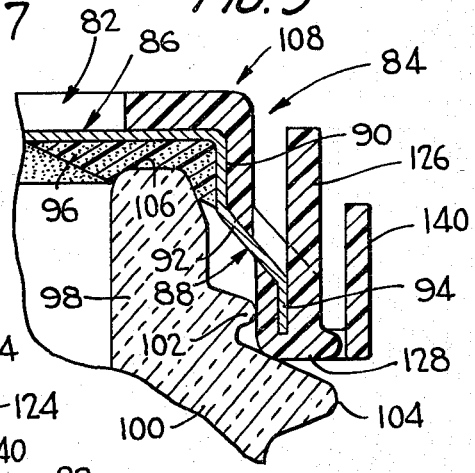
FIG. 9 is an enlarged fragmentary sectional view similar to portion of FIG. 7, and shows the closure applied to the neck finish of a glass container.
Figure 7:
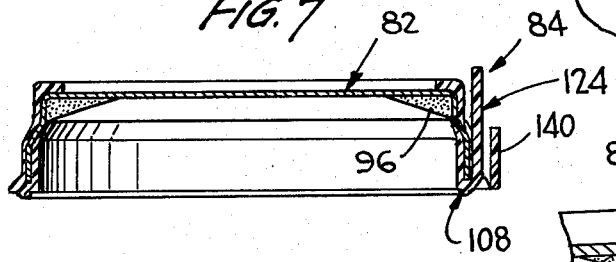
FIG. 7 is a transverse vertical sectional view taken along line 7—7 of FIG. 6, and shows more specifically the constructional details of the closure and lever mechanism.
Figure 10:
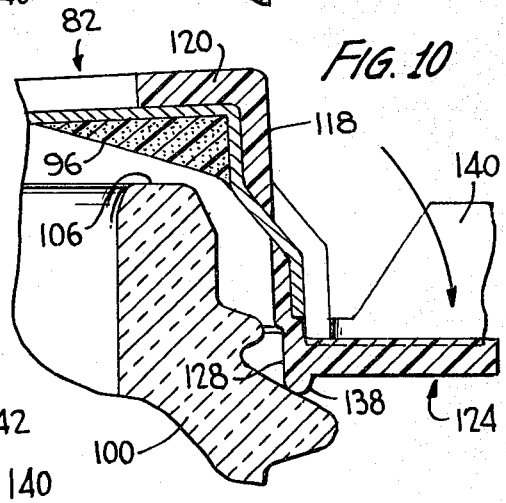
FIG. 10 is an enlarged fragmentary sectional view similar to FIG. 9, and shows the lever actuated to lift or pry the closure out of contact with the container.

As will be readily apparent from FIG. 9, when the closure 82 together with the lever mechanism 84 is applied to the container 100, the lower portion 94 of the skirt, as well as the ring 110, is stabilized by the bead 102. At the same time the band 108 has the lower inner ring 110 thereof stabilized by the lower portion of the skirt including the shoulder 92. Thus, when the arm 126 is pivoted in a clockwise direction and the base of the lever 124 engages the shoulder 104, a prying or lifting action results as is shown in FIG. 10. This will be enhanced by the bead 138 to provide additional lift. The closure 82 will be lifted sufficiently for the sealing ring 96 to be disengaged from the sealing finish 106 and permit the external air to enter into the container 100 and relieve the vacuum therein. The closure 82 may then be readily removed.

When it is desired to provide the lever mechanism 84 with a tamper-indicating device, there may be formed integrally with the band 108 a strap 140 which extends across and is disposed radially outwardly of the arm 126. The strap 140 has one lower end edge portion thereof connected to the ring 114 of the band 108 by a hinge connection 142 and the opposite lower end edge thereof connected to the ring 114 by a rupturable connection 144. Thus, when the arm 126 is pivoted downwardly to effect a prying of the closure from the container, before the lever 124 can be effected, the strap 140 must be displaced so as to give evidence of the fact that at least there has been tampering and the possibility of the vacuum within the container being at least partially relieved.

With respect to the embodiment of FIGS. 6–11, a 58 mm closure has been tested, and in addition to the normally sustaining vacuum pressure differential force of 36 pounds holding the closure seated on the container, a 20 pound weight has been added and the lever mechanism has been successfully actuated to lift the closure and break the vacuum.

Although only two preferred embodiments of the closure and lever mechanisms have been specifically illustrated and described herein, it is to be understood that minor variations may be made in the lever mechanism without departing from the spirit and scope of the invention as defined by the appended claims.

We claim:

1. A closure comprising a shell including an end panel and a depending uninterrupted conventional skirt, there being an annular corner between said end panel and said skirt, a sealing ring underlying said end panel generally at said corner, and lever means and support means for said lever means formed separately of said shell and carried by said skirt, said lever means being positioned for engaging a container shoulder to lift said shell.

2. A closure according to claim 1 wherein said lever means includes a generally L-shaped lever member including a generally horizontal base and an upstanding arm, and said base being hingedly connected to said support means remote from said arm.

3. A closure according to claim 2 together with tamper-indicating means normally preventing pivoting of said arm to a lever operative position.

4. A closure according to claim 2 together with tamper indicating means normally preventing pivoting of said arm to a lever operative position, said tamper-indicating means including at least one rupturable connection between said support means and said arm.

5. A closure according to claim 2 together with tamper indicating means normally preventing pivoting of said arm to a lever operative position, said tamper-indicating means including a retaining strap carried bysaid support means and being disposed radially outwardly of said arm.

6. A closure according to claim 5 wherein said retaining strap has circumferentially spaced ends with one of said ends having a rupturable connection with said support means.

7. A closure according to claim 1 together with tamper indicating means normally preventing actuation of said lever means.

8. A closure according to claim 7 wherein said support means includes a band interlocked with said skirt.

9. A closure according to claim 1 together with tamper indicating means normally preventing actuation of said support means means, said lever including at least an L-shaped part including an upstanding leg and a horizontal leg, said upstanding leg being disposed within said skirt and said horizontal leg underlying said skirt.

10. A closure according to claim 9 wherein said skirt has an intermediate radially outwardly directed shoulder, and said upstanding leg has an upper end portion bearing against said shoulder for resisting twisting of said band during the use of said lever means.

11. A closure according to claim 9 wherein said skirt terminates in a curl, and there is an external socket between said legs interlockingly receiving said curl.

12. A closure according to claim 9 wherein said band is releasably interlocked with said skirt.

13. A closure according to claim 9 wherein said band is permanently molded in situ.

14. A closure according to claim 9 wherein said band is permanently molded in situ, and has a radially outer portion disposed exteriorly of said skirt.

15. A closure according to claim 9 wherein said band is permanently molded in situ, and has a radially outer portion disposed exteriorly of said skirt and overlying said end panel.

* * * * *